US009002235B2

(12) United States Patent
Hymas

(10) Patent No.: US 9,002,235 B2
(45) Date of Patent: Apr. 7, 2015

(54) TONER CARTRIDGE PACKAGING

(71) Applicant: Hewlett-Packard Development Company, LP., Houston, TX (US)

(72) Inventor: Scott K. Hymas, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 106 days.

(21) Appl. No.: 13/779,311

(22) Filed: Feb. 27, 2013

(65) Prior Publication Data

US 2014/0241754 A1 Aug. 28, 2014

(51) Int. Cl.

| | |
|---|---|
| ***G03G 21/16*** | (2006.01) |
| ***G03G 15/00*** | (2006.01) |
| ***B65D 81/02*** | (2006.01) |
| ***B65D 5/42*** | (2006.01) |
| *G03G 21/18* | (2006.01) |

(52) U.S. Cl.

CPC ..... *G03G 15/75* (2013.01); *G03G 21/181* (2013.01); *B65D 81/022* (2013.01); *B65D 5/4212* (2013.01)

(58) Field of Classification Search

CPC ..... G03G 21/181; G03G 15/75
USPC ..... 399/107, 109, 111; 206/223, 509, 521, 206/525, 588
See application file for complete search history.

(56) References Cited

U.S. PATENT DOCUMENTS

| | | | | |
|---|---|---|---|---|
| 4,502,514 | A * | 3/1985 | Ballard et al. | 141/1 |
| 5,125,509 | A * | 6/1992 | Takei et al. | 206/719 |
| 5,153,643 | A * | 10/1992 | Nagakura | 399/106 |
| 5,307,117 | A * | 4/1994 | Harlan | 206/521 X |
| 5,645,167 | A * | 7/1997 | Conrad | 206/361 |
| 5,685,431 | A * | 11/1997 | Chambers et al. | 206/521 |
| 5,871,097 | A * | 2/1999 | Shida et al. | 206/521 |
| 6,942,325 | B2 | 9/2005 | Nanjo | |
| 7,198,155 | B2 * | 4/2007 | Otsuka et al. | 206/576 |
| 7,278,249 | B2 * | 10/2007 | Kari | 206/588 X |
| 7,636,529 | B2 * | 12/2009 | Kamimura | 399/107 |
| 7,992,715 | B2 * | 8/2011 | Kwon | 206/588 |
| 8,331,831 | B2 * | 12/2012 | Aoki et al. | 399/107 X |

FOREIGN PATENT DOCUMENTS

| | | | |
|---|---|---|---|
| CN | 201864112 | U | 6/2011 |
| CN | 202133863 | U | 2/2012 |
| JP | 11049246 | A | 2/1999 |

OTHER PUBLICATIONS

INTEL, "Chapter 16: Cartridge Packaging," 2000 Packaging Databook, Feb. 25, 2000 (22 pages).

* cited by examiner

*Primary Examiner* — Sandra Brase
(74) *Attorney, Agent, or Firm* — Hewlett-Packard Patent Department

(57) ABSTRACT

A toner cartridge packaging having a non-planar top surface is disclosed.

20 Claims, 7 Drawing Sheets

TONER CARTRIDGE PACKAGING

BACKGROUND

Toner cartridges are to be installed in a printer to provide toner particles to the printer. For example the toner particles consist of electrically chargeable particles and colorants in a powder or liquid carrier material. Known toner cartridges include series of rollers to transfer the toner from an internal reservoir to print media. For example, an organic photoconductor (OPC) roller retrieves a layer of toner from a developer roller and transfers the layer in the form of an image to the media, directly or in some instances via an intermediary roller. Toner cartridges oftentimes include one or both of a shutter and a protective cover that protects the sensitive photoconductor roller when it is not installed in the printer. In certain instances the printer and toner cartridge are arranged so that the shutter is automatically opened at installation of the cartridge in the printer. In other instances the protective cover or shutter needs to be removed or opened manually before installation of the cartridge in the printer to expose the photoconductor roller.

BRIEF DESCRIPTION OF THE DRAWINGS

For the purpose of illustration, certain examples constructed in accordance with the teachings of this disclosure will now be described with reference to the accompanying drawings, in which.

DETAILED DESCRIPTION

In the following detailed description, reference is made to the accompanying drawings. The examples in the description and drawings should be considered illustrative and are not to be considered as limiting to the specific example or element described. Multiple examples may be derived from the following description and/or drawings through modification, combination or variation of certain elements.

Figure 1:
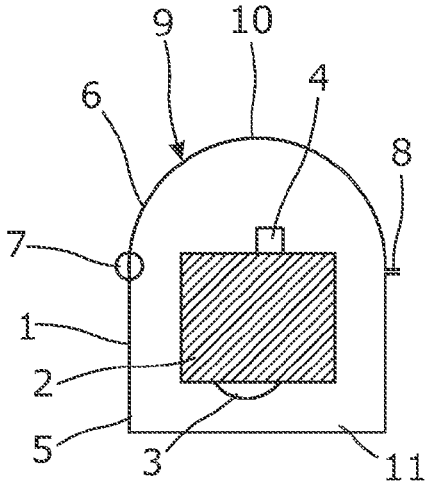
FIG. 1 illustrates a diagram of an example of an assembly of a toner cartridge and packaging in an upright position.
Figure 2:
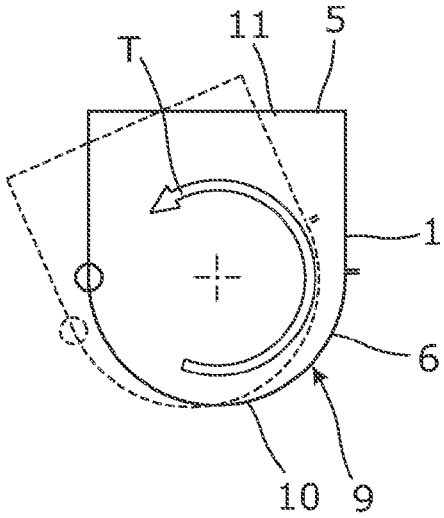
FIG. 2 illustrates a diagram of the example assembly of FIG. 1 with a non-planar surface facing downwards.
Figure 3:
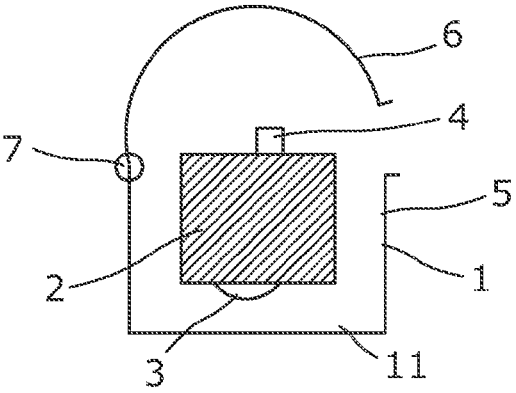
FIG. 3 illustrates a diagram of the example assembly of FIGS. 1 and 2 with the non-planar surface facing upwards, the packaging being in an upright position and partially opened.

FIGS. 1-3 illustrate an example of a packaging 1 and a toner cartridge 2 of this disclosure. FIGS. 1 and 3 represent an intended, upright position of the example packaging 1 and FIG. 2 illustrates a non-intended upside-down orientation of the packaging 1.

The toner cartridge 2 includes a toner transfer roller 3. For example the toner transfer roller 3 is a photoconductor roller for transferring a layer of toner in the form of an image to print media. In another example the toner transfer roller 3 is an intermediate transfer roller for transferring the image from a photoconductor roller to the print media. For example the toner contains dry toner particles. For example, the packaged toner transfer roller 3 is exposed, that is, not covered or protected by a separate cover or shutter. The packaging 1 includes a bottom portion 5 and a top portion 6. For example the cartridge 2 is fitted to inner walls of the bottom portion 5. For example the cartridge 2 is press fitted to the inner walls of the bottom portion 5. For example the bottom portion 5 is larger than the top portion 6, to support and substantially surround the cartridge 2.

For example the toner transfer roller 3 can be regarded as a sensitive component. For example unintentionally touching the surface of the toner transfer roller 3, for example with hands or other printer parts, should be avoided. For example touching the toner transfer roller 3 can affect the transfer characteristics of the toner transfer roller 3.

The packaging 1 includes a non-planar top surface 9. For example the top surface 9 has an at least partially convex or curved shape. For example the packaging 1 has a support surface 11 at the bottom to place the packaging 1 on a second support surface such as a table, shelf or on a printer housing. For example the support surface 11 of the packaging 1 is flat, or includes feet, for allowing placement on its support surface 11 with a reduced risk of tumbling the packaging 1. For example the non-planar top surface 9 includes a top ridge 10. For example the top ridge 10 is the top edge of the top surface 9 that is furthest away from the support surface 11 of the cartridge 2.

Tests have shown that users tend to place the packaging 1 with the non-planar surface 9 upwards. This may be explained with reference to the example FIG. 2 that illustrates how the packaging 1 can tumble in direction T when trying to position it on the non-planar top surface 9. To avoid unstable positioning as illustrated by FIG. 2, the non-planar top surface 9 accomplishes that the packaging 1 is placed on its support surface 11 at the bottom instead of the top surface 9, at least in most cases. Within the packaging 1 the cartridge 2 can be fitted in the bottom portion 5 while the toner transfer roller 3 faces downwards towards the support surface 11, or for example towards one of the sides of the packaging 1. For example the packaged orientation of the cartridge 2, at least when the packaging 1 has an upright orientation, corresponds to a printer installation orientation of the cartridge 2, for example because the toner transfer roller 3 needs to be installed with the exposed face down (as illustrated) or with the exposed face towards one of the sides.

For example, the non-planar top surface 9 is located near the side of the cartridge 2 that should be up when the user installs the cartridge 2, and the support surface 11 is located near the side of the cartridge 2 that should be down when the user installs the cartridge 2 in the printer. Hence when the packaging 1 is opened (FIG. 3), the cartridge 2 can be taken out (i) with a reduced risk that the toner transfer roller 3 is touched and (ii) in an installation-ready orientation. For example, the toner transfer roller 3 is already exposed within the packaging 1, that is, not covered or protected by a separate cover or shutter, so that the cartridge 2 can be readily installed without needing to displace such cover or shutter. This may lead to less complex mechanisms. For example, the cartridge 2 and/or printer do not need to include a shutter opening mechanism. For example, the user does not need to complete a delicate operation such as uncovering a shutter or cover from the toner transfer roller 3. Pre-orienting the cartridge 2 can prevent touching or damaging the toner transfer roller 3, which may prevent some of the effects explained below.

For example, damage to an organic photoconductor (OPC) by accidental contact by humans can be temporary or permanent, which can result in image defects. In most instances, the surface of the OPC must be able to accept a constant charge that produces a uniform high voltage and then be locally discharged, for example in areas as small as approximately $1/1200^{th}$ by $1/1200^{th}$ of an inch. Oils, either natural or artificially applied to a human, say on the hands, can be conductive enough to allow the image applied to the OPC to be blurred by surface conductivity. This effect can depend on the environment. For example this effect can increase in humid conditions. Said oils may also disturb the ability of the development system to uniformly apply an even layer of toner to the OPC, causing print quality defects. Since the exposed layer of the OPC is an organic conductor which is doped to specific levels with additives to adjust the specific conductivity of the layer, contamination by touching can accidentally apply materials that will chemically interact with the layer and permanently change the local bulk conductivity of the device. The oils may also transfer to other components of the system, such as the intermediate transfer belt (ITB) where they can cause transfer defects from not only the OPC that was contaminated but from other OPC's within the print system. In addition, many people who accidentally touch OPC's are wearing personal jewelry, such as rings, that are much harder than the OPC and which can cause permanent damage by scratching, denting, or chipping the surface, causing continuing print quality (PQ) defects for the rest of the life of that OPC.

For example the toner cartridge 2 includes an additional handle 4 for manually grabbing and handling the toner cartridge 2. For example the handle 4 is located at a distance from the toner transfer roller 3, to invite a user to manually engage the cartridge 2 at a distance from the toner transfer roller 3, to avoid that a user touches the toner transfer roller 3, when lifting the cartridge 2 out of the packaging 1 or printer. For example the handle 4 is located approximately on the opposite side of the cartridge 2 with respect to the toner transfer roller 3. For example the handle 4 is located so that it aids in manually installing the cartridge 2 in the printer. For example in packaged condition the handle 4 extends below and near the top ridge 10 of the top portion 6 of the packaging 1.

For example, the packaging 1 is substantially composed of bio-degradable material, arranged in a shock absorbing construction. For example the packaging is monolithic. For example the packaging 1 is molded, for example compression molded or injection molded. For example the packaging 1 includes or is made of cellulose fibers, paper, carton, styrofoam, plastics, expanded polystyrene, starch, egg carton, or other suitable material. For example the packaging includes or is made of molded and/or compressed pulp or fibers.

For example the packaging 1 includes a hinge 7 for hinging the top portion 6 with respect to the bottom portion 5 for opening the packaging. For example the hinge 7 is a living hinge. For example the packaging 1 includes a closure 8 for retaining the top portion 6 with respect to the bottom portion 5. For example the closure 8 is positioned opposite to the hinge 7. For example the closure 8 is a snap closure. For example the closure 8 consists of two protruding and interlocking lips, disposed opposite to each other on the bottom and top portion 5, 6. In other examples (not shown) the packaging 1 does not include a hinge. For example in these other examples the top portion 6 can be detached from the bottom portion 5.

Figure 4:
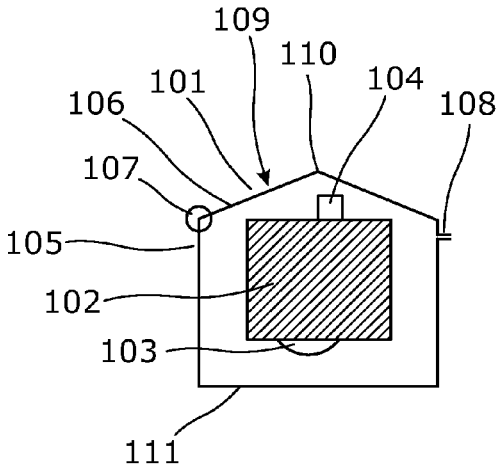
FIG. 4 illustrates a diagram of an example of an assembly of a toner cartridge and packaging, in an upright position.
Figure 5:
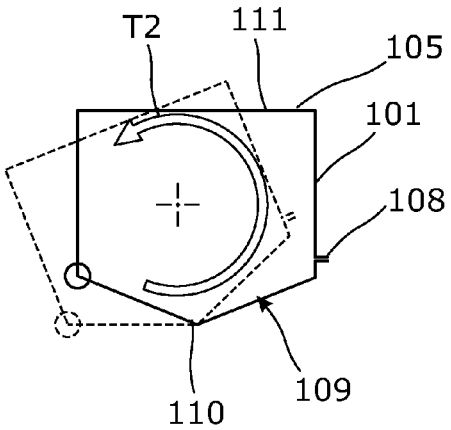
FIG. 5 illustrates a diagram of the example assembly of FIG. 4 with a non-planar surface facing downwards.
Figure 6:
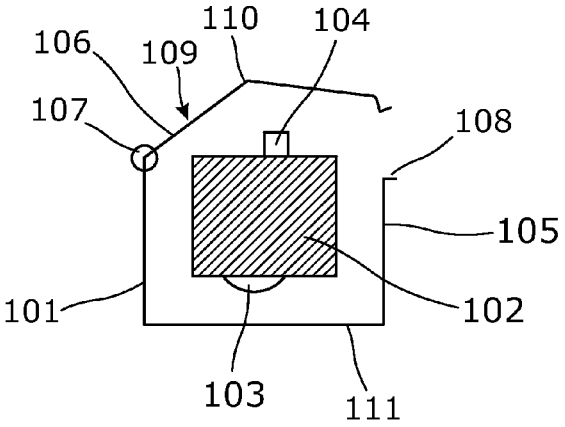
FIG. 6 illustrates a diagram of the example assembly of FIGS. 4 and 5 with the non-planar surface facing upwards, the packaging being in an upright position and partially opened.

FIGS. 4-6 illustrate another example of a toner cartridge 102 and its packaging 101 that is similar to the example of FIGS. 1-3. FIGS. 4 and 6 represent an intended, upright position of the example packaging 101 and FIG. 5 illustrates a non-intended orientation of the packaging 101. A top portion 106 of the packaging 101 hinges with respect to a bottom portion 105 over a living hinge 107 and closes with the aid of a snap closure 108 disposed opposite to the living hinge 107. The cartridge 102 is fitted to the bottom portion 105, for example press fitted. For example the toner transfer roller 103 faces downwards. A portion of the toner transfer roller 103 is exposed within the packaging 101, "exposed" meaning that no shutter or cover covers that portion of the toner transfer roller 103. For example, the cartridge 102 includes a handle 104 distanced from the toner transfer roller 103, for example protruding away from the toner transfer roller 103, for example upwards.

The top portion 106 includes a non-planar top surface 109. Similar to the example of FIGS. 1-3, the non-planar top surface 109 includes a top ridge 110 that protrudes away from the support surface 111. Different from the example of FIGS. 1-3, the non-planar top surface 109 of the example of FIGS. 4-6 has a tapering shape wherein two converging surfaces meet at the top ridge 110. The top ridge 110 points away from the support surface 111 of the packaging 101. Similar to FIGS. 1-3 the upwards tapering top surface 109 of the packaging 101 can accomplish that the packaging 101 is placed on its bottom support surface 111 instead of its top surface 109. This may be explained with reference to the example FIG. 5 that illustrates how the packaging 101 can tumble in direction T2 when trying to position it on the non-planar top surface 109. For example, the non-planar top surface 109 is located near the side of the cartridge 102 that should be up when the user installs the cartridge 102 in a printer, while a support surface 111 of the packaging is located near the side of the cartridge 102 that should be down when the user installs the cartridge 102 in the printer. For example in packaged condition the handle 104 of the cartridge 102 is disposed near or in the non-planar top surface 109 of the packaging 101.

Figure 7:
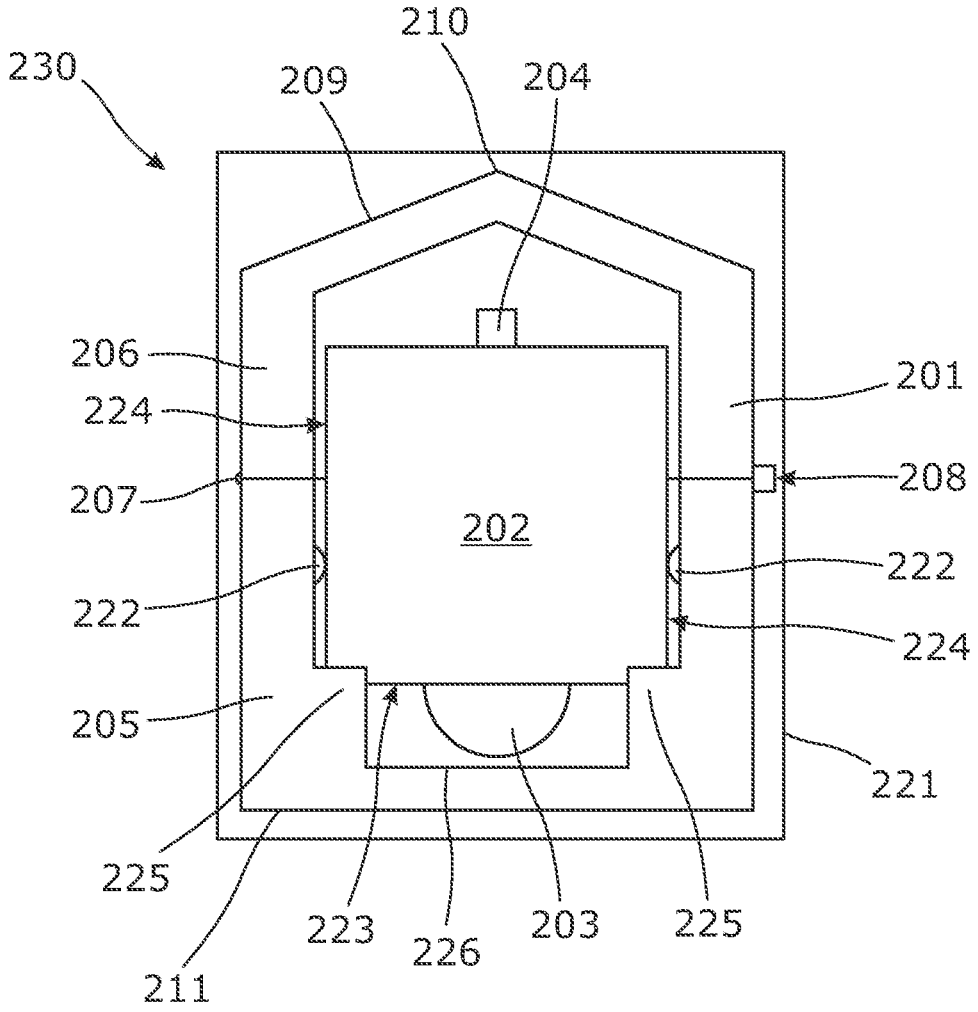
FIG. 7 illustrates a diagram of another example of an assembly of a toner cartridge and packaging.

FIG. 7 illustrates another example of an assembly 230 of a cartridge 202 and packaging 201, 221. For example the packaging includes a first packaging and a second packaging, wherein the first packaging is an inner packaging 201 and the second packaging is an outer packaging 221. In FIG. 7 the cartridge 202 is supported and surrounded by the inner packaging 201 and the inner packaging 201 is surrounded by the outer packaging 221. However, the inner packaging 201 can also serve as outer packaging by itself, without the illustrated outer packaging 221.

The inner packaging 201 can have a shock dampening function. For example the inner packaging 201 includes cushions for supporting the cartridge 202 within the outer packaging 221. For example, the inner packaging 201 is monolithic. For example, the inner packaging 201 is substantially composed of bio-degradable material. For example the inner packaging 201 is molded, for example compression molded. For example the inner packaging 201 includes or is made of cellulose fibers, paper, carton, styro-foam, plastics, expanded polystyrene, starch, egg carton, or other suitable material. For example the inner packaging 201 includes or is made of molded and/or compressed pulp or fibers.

For example the inner packaging 201 includes a bottom portion 205 and a top portion 206, the top portion 206 being at least partly separable from the bottom portion 205 for opening the inner packaging 201. For example the inner packaging 201 includes a hinge 207 and a closure 208. For example the top portion 206 is to hinge about the hinge 207 that is disposed at the side of the packaging 201. For example the top portion 206 is to be closed about the closure 208 that is disposed approximately opposite to the hinge 207. For example the hinge 207 is a living hinge, and the closure is a snap closure 208. In other examples the closure 208 is to be torn open. For example the closure 208 is a welded closure.

For example the bottom portion 205 of the cartridge 202 includes cushions 222, 225. For example, the cushions 222, 225 form an integral part of the monolithic inner packaging 201. For example the cartridge 202 is press-fitted into the cushions 222, 225 of the bottom portion 205. For example the cushions 222, 225 are support elements that deform under pressure or sudden impacts to absorb shocks. The cushions 222, 225 include at least one of appropriate material and appropriate construction for achieving the shock absorbing function. For example the inner packaging 201 includes side cushions 222, 225 engaging longitudinal sides 224 of the cartridge 202. For example the inner packaging 201 includes bottom cushions 225 engaging the cartridge 202 near a longitudinal bottom side 223 of the cartridge 202, which in an example is the side 223 of a toner transfer roller 203. For example the inner packaging 201 includes head cushions engaging longitudinal ends of the cartridge 202 (not illustrated). For example the bottom portion 205 is arranged to receive the cartridge 202 by press fitting the cartridge 202 downwards into the cushions 222, 225. In an example the top portion 206 includes top cushions for engaging the cartridge 202, but the cartridge 202 is not press fitted to the top portion 206.

For example the toner transfer roller 203 is exposed near an inner bottom 226 of the bottom portion 205 of the inner packaging 201. For example some of the cushions 222, 225 of the inner packaging 201 support the cartridge 202 so that the toner transfer roller 203 does not contact any of the inner walls of the inner packaging 201. For example the exposed toner transfer roller 203 is distanced from the inner bottom 226 at least multiple millimeters. In other examples the toner transfer roller 203 is exposed near one of the transversal sides of the packaging 201.

For example at least a portion of the inner walls of the inner packaging 201 is coated to inhibit detaching of flakes, fibers, dust or the like from the inner walls, and to avoid contamination of the exposed toner transfer roller 203. In an example a bed or cover or the like (not illustrated) is disposed over the inner bottom 226 of the inner packaging 201 for additional protection of the toner transfer roller 203 and/or inhibit contamination of the toner transfer roller 203. For example, such bed or cover would be left behind in the inner packaging 201 when lifting the cartridge 202 out of the packaging 201.

For example, the inner packaging 201 includes a support surface 211 and a non-planar top surface 209. The support surface 211 includes feet or a flat surface for placing the inner packaging 201 on its support surface 211 onto a second support surface such as a table, shelf, floor, etc. In the illustrated example, the non-planar top surface 209 has a tapered shape but in other examples the shape can be rounded or otherwise non-planar to avoid placement of the inner packaging 201 on its top surface 209, as explained previously. For example, the top surface 209 includes a top ridge 210 where the tapering top surfaces meet, or at the top of a rounded roof.

For example the outer packaging 221 includes graphics and/or information about the contents of the complete assembly 230, and can be torn open or unfolded or the like. For example the inner packaging 201 is to be lifted out of the outer packaging 221, whereby it is placed on its support surface 211 so that the cartridge 202 is pre-oriented in the installation orientation as explained previously. For example the closure 208 is to be opened and the top portion 206 is to be hinged open. For example the cartridge 202 is to be manually engaged for installation without touching the toner transfer roller 203. For example, the cartridge 202 includes a handle 204 that protrudes at a cartridge location that is distanced from the longitudinal bottom side 223 and that is visible when opening the inner packaging 201. For example the cartridge 202 is to be lifted out of the upright inner packaging 201, and then installed in the printer in approximately the same orientation as the packaged orientation.

Figure 8:
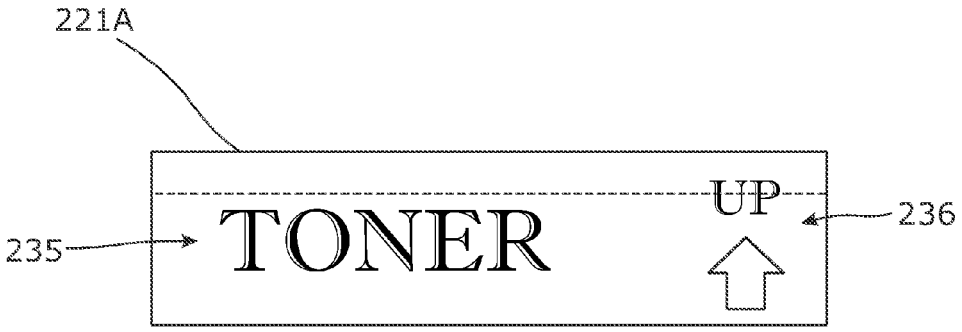
FIG. 8 illustrates a diagram of an example of an outer packaging of a toner cartridge.
Figure 9:
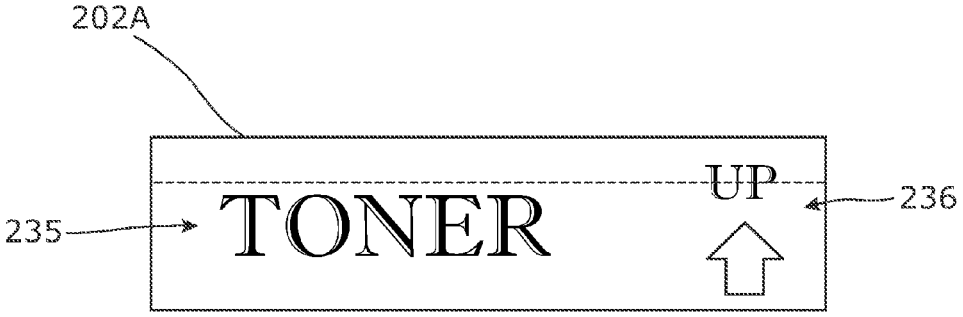
FIG. 9 illustrates a diagram of an example of an inner packaging of a toner cartridge.

For example the outer packaging 221A includes a first indication 235 that the assembly 230 contains a toner or a toner cartridge 202 and/or second indication 236 for what is top or bottom (FIG. 8). For example the first indication 235 can be a picture, symbol or word that indicates that there is toner or a toner cartridge inside the packaging 221A. For example the second indication 236 can be an arrow, picture, symbol or word that indicates which side of the packaging 221A should go up or down. For example, the indications 235, 236 are printed or embossed. In addition or alternatively at least one of these indications 235, 236 can be provided on the inner packaging 202A (FIG. 9), for example through embossing or printing.

Figure 10:
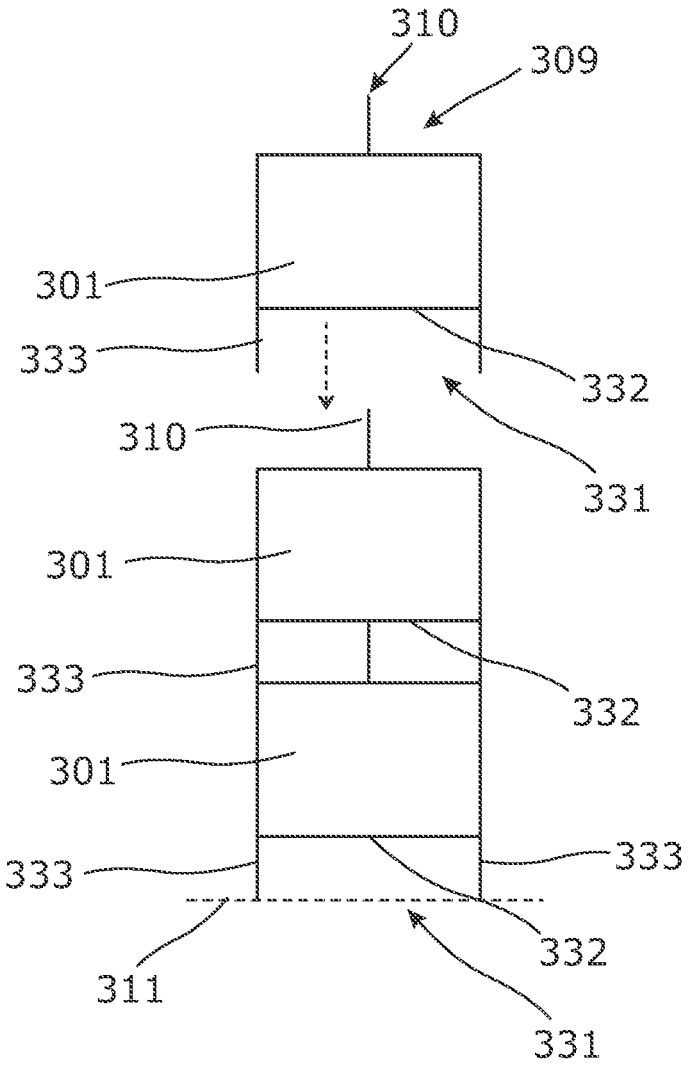
FIG. 10 illustrates a diagram of examples of stacked toner cartridge packages.

FIG. 10 illustrates an example of stacked stackable packages 301. For example the packages 301 include a top surface 309 having a raised top ridge 310. For example the illustrated top surface 309 includes a protruding flap. For example the top surface 309 includes a tapered, round or otherwise non-planar surface 309. For example the packages 301 have a bottom surface 331. For example the bottom surface 331 includes the support surface 311 which can be formed by feet 333 or a support ridge, for example disposed under outer side walls of the packaging 301, for placing the packaging 301 onto a second support surface such as a table or shelf. The bottom surface 331 further includes a raised portion 332, forming a bottom portion that is raised with respect to the support surface 311, so that a top ridge 310 of a packaging 301 underneath it can protrude into the raised portion 332. Hence, a top packaging 301 can receive a top ridge 310 of another first packaging 301 below it. For example, the top ridge 310 of a lower packaging 301 extends between the feet 333 or support ridges of a packaging 301 on top. The raised portion 332 allows for stacking the packages 301 having non-planar top surfaces 309. For example the packaging 301 is nestable. For example the packaging 301 is nestable in an empty and open condition, for example for transporting empty inner packages 301.

Figure 11:
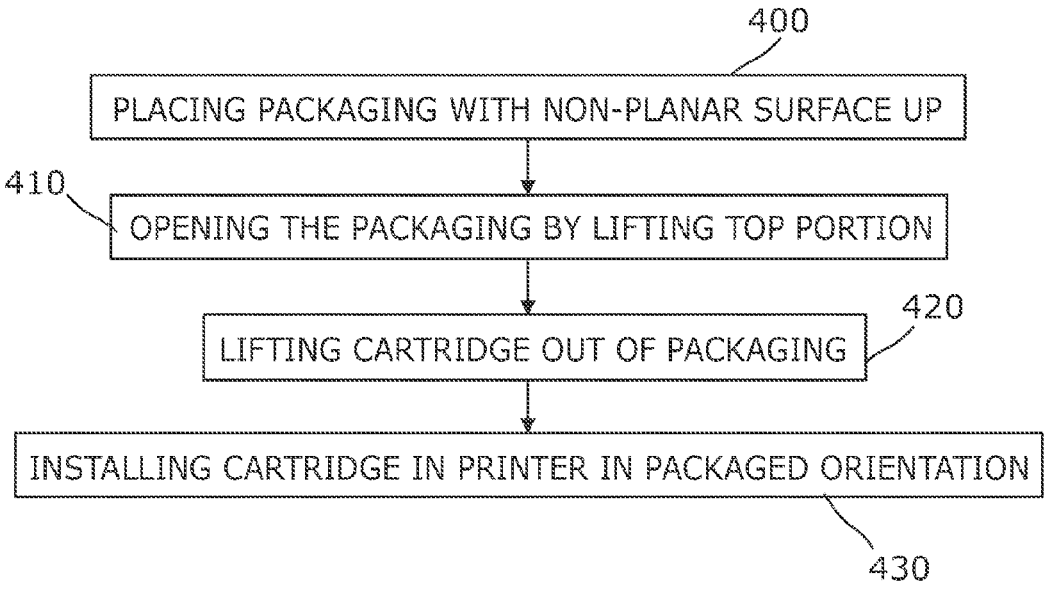
FIG. 11 illustrates a flow chart of an example of installing a toner cartridge.

FIG. 11 illustrates a flow chart of an example of a method of installing a toner cartridge 2, 102, 202 in a printer. For example the method includes placing a first packaging 1, 101, 201, 301 so that a non-planar surface 9, 109, 209, 309 is facing upwards (block 400). For example, the method includes opening the first packaging 1, 101, 201, 301 by at least partly lifting a top portion 6, 106, 206 with respect to a bottom portion 5, 105, 205 (block 410). For example, the method includes lifting the toner cartridge 2, 102, 202 out of the bottom portion 5, 105, 205 (block 420), for example approximately maintaining its packaged orientation. For example, the method includes installing the toner cartridge 2, 102, 202 in a printer in approximately its packaged orientation (block 430).

Figure 12:
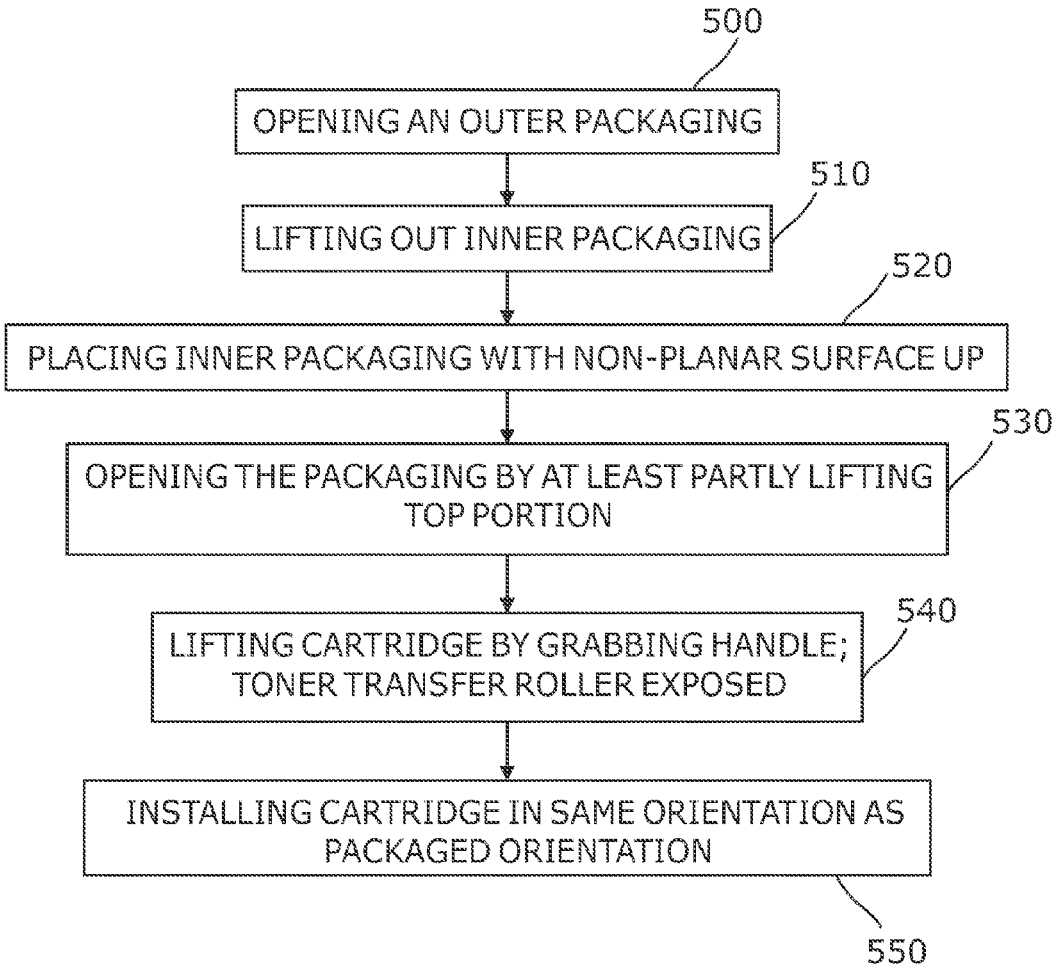
FIG. 12 illustrates a flow chart of another example of installing a toner cartridge.

FIG. 12 illustrates a flow chart of another example of a method of installing a toner cartridge 202 in a printer. For example, the method includes opening a second, outer packaging 221 (block 500). For example, the method includes lifting a first, inner packaging 201 out of the outer packaging 221 (block 510). For example, the method includes placing the inner packaging 201 in upright position so that a non-planar surface 209 is facing upwards (block 520). For example, the method includes opening the first packaging 201 by at least partly lifting a top portion 206 with respect to a bottom portion 205 (block 530), for example by hinging or detaching the top portion 206. For example, the method includes grabbing a handle 204 for lifting the cartridge 202 out of the first packaging 201 while a toner transfer roller 203 is pre-exposed (block 540), that is, not covered by a shutter or separate cover. For example, the method includes lifting the toner cartridge 202 out of the bottom portion 205, and installing the toner cartridge 202 in a printer in approximately its packaged orientation (block 550). For example, the toner cartridge 202 is packaged and installed with the toner transfer roller 203 facing approximately downwards. In other examples, the toner transfer roller 203 is packaged and installed facing approximately sideways, that is, in an at least partly horizontal direction.

The above description is not intended to be exhaustive or to limit this disclosure to the examples disclosed. Other variations to the disclosed examples can be understood and effected by those of ordinary skill in the art from a study of the drawings, the disclosure, and the claims. The indefinite article "a" or "an" does not exclude a plurality, while a reference to a certain number of elements does not exclude the possibility of having more or less elements. A single unit may fulfil the functions of several items recited in the disclosure, and vice versa several items may fulfil the function of one unit. Multiple alternatives, equivalents, variations and combinations may be made without departing from the scope of this disclosure.

What is claimed is:

1. A packaged toner cartridge comprising:

a toner cartridge, and a packaging having a non-planar top surface and a planar bottom surface opposite the top surface, wherein the cartridge is fitted to inner walls of a bottom portion of the packaging and fully enclosed between the top and bottom surfaces, the non-planar top surface extending above the cartridge with a profile independent of a shape of the cartridge.

2. The packaged toner cartridge of claim 1, wherein the cartridge comprises an exposed toner transfer roller.

3. The packaged toner cartridge of claim 2, wherein the toner transfer roller is exposed towards the bottom surface of the packaging.

4. The packaged toner cartridge of claim 2, wherein the toner transfer roller is a photoconductor roller.

5. The packaged toner cartridge of claim 1, wherein the top surface comprises a top ridge.

6. The packaged toner cartridge of claim 5, wherein the packaging is stackable, and a raised portion in the bottom surface is to receive a top ridge of another packaging underneath.

7. The packaged toner cartridge of claim 1, wherein the cartridge comprises a top handle facing the non-planar top surface.

8. The packaged toner cartridge of claim 1, further comprising an outer packaging around the packaging.

9. The packaged toner cartridge of claim 8, wherein the first packaging is to dampen shocks to the cartridge.

10. The packaged toner cartridge of claim 1, wherein the cartridge is press fitted to the inner walls of the bottom portion of the packaging.

11. The packaged toner cartridge of claim 1, wherein the packaging comprising a living hinge to hinge a top portion with respect to the bottom portion.

12. The packaged toner cartridge of claim 11, wherein the packaging comprising a snap closure opposite to the hinge.

13. The packaged toner cartridge of claim 1, wherein the bottom portion is larger than a top portion.

14. The packaged toner cartridge of claim 1, wherein the packaging includes side surfaces extending between the top and bottom surfaces, the packaging to be constructed such that when the bottom surface rests on a flat surface the side surfaces are substantially perpendicular to the flat surface and when the top surface rests on the flat surface the side surfaces are substantially non-perpendicular to the flat surface.

15. A toner cartridge packaging comprising, a monolithic biodegradable inner packaging including:

a planar bottom surface, planar side surfaces substantially perpendicular to the bottom surface, a bottom portion having internal cushions to support a toner cartridge, a top portion having a top ridge to prevent the inner packaging from being supported by a flat surface with the side surfaces in an upright orientation when the top portion is facing downward, the bottom portion being larger than the top portion, a living hinge to hinge the top portion with respect to the bottom portion, and a snap closure opposite to the living hinge; and an outer packaging comprising a first indication that the packaging contains a toner cartridge and a second indication to identify at least one of a top and a bottom of the outer packaging, wherein the inner packaging is to fit in and be surrounded by the outer packaging.

16. A method of installing a toner cartridge, comprising;

placing a packaging with a planar bottom surface facing downward so that a non-planar top surface, opposite the bottom surface, is facing upwards, the non-planar top surface to extend above the toner cartridge with a profile independent of a shape of the cartridge;

opening the packaging by at least partly lifting a top portion of the packaging with respect to a bottom portion, a majority of the toner cartridge to be within the bottom portion;

lifting the toner cartridge out of the bottom portion; and installing the toner cartridge in a printer in approximately its packaged orientation.

17. The method of claim 16, further comprising opening an outer packaging, and lifting the packaging out of the outer packaging.

18. The method of claim 16, further comprising grabbing a handle of the toner cartridge to lift the cartridge out of the packaging in an upright orientation, without touching a toner transfer roller.

19. The method of claim 16, wherein a toner transfer roller of the toner cartridge is exposed while in a packaged condition to be ready for installation in the printer without needing to uncover the toner transfer roller before or during installation.

20. The method of claim 19, wherein the toner transfer roller is a photoconductor roller.

* * * * *

UNITED STATES PATENT AND TRADEMARK OFFICE

CERTIFICATE OF CORRECTION

PATENT NO. : 9,002,235 B2
APPLICATION NO. : 13/779311
DATED : April 7, 2015
INVENTOR(S) : Hymas It is certified that error appears in the above-identified patent and that said Letters Patent is hereby corrected as shown below:

In the Claims

Column 7, line 64, Claim 9, delete “the first” and insert -- the --, therefor.

Column 8, line 17, Claim 15, delete “comprising,” and insert -- comprising; --, therefor.

Signed and Sealed this
Twenty-second Day of September, 2015

Michelle K. Lee

Michelle K. Lee
*Director of the United States Patent and Trademark Office*